US007854238B2

(12) United States Patent
Zatarain

(10) Patent No.: US 7,854,238 B2
(45) Date of Patent: Dec. 21, 2010

(54) CONDUIT TRAP AND CONDENSATION RECOVERY DEVICE

(76) Inventor: Jesus M. Zatarain, 1251 E. Cantu, Calexico, CA (US) 92231

( * ) Notice: Subject to any disclaimer, the term of this patent is extended or adjusted under 35 U.S.C. 154(b) by 520 days.

(21) Appl. No.: 11/850,645

(22) Filed: Sep. 5, 2007

(65) Prior Publication Data

US 2009/0056346 A1 Mar. 5, 2009

(51) Int. Cl.
*F24F 13/22* (2006.01)
*F25D 21/14* (2006.01)
*F16K 13/10* (2006.01)

(52) U.S. Cl. ..... 137/247.21; 137/247.11; 137/247.13; 137/247.15; 62/373; 62/285

(58) Field of Classification Search ..... 137/247.11, 137/247.13, 247.15, 247.17, 247.21, 247.41; 62/272, 285, 288, 289, 290, 281
See application file for complete search history.

(56) References Cited

U.S. PATENT DOCUMENTS

| | | | | | |
|---|---|---|---|---|---|
| 56,478 | A * | 7/1866 | Williams | ..... | 137/247.21 |
| 139,739 | A * | 6/1873 | Shaw et al. | ..... | 137/247.21 |
| 174,874 | A * | 3/1876 | Thorp | ..... | 137/247.21 |
| 179,881 | A * | 7/1876 | Underwood | ..... | 137/247.21 |
| 4,693,091 | A * | 9/1987 | O'Mara et al. | ..... | 62/272 |
| 4,918,940 | A * | 4/1990 | Buckley | ..... | 62/285 |
| 5,069,042 | A * | 12/1991 | Stuchlik, III | ..... | 62/289 |
| 5,644,925 | A * | 7/1997 | Chaves | ..... | 62/289 |
| 6,895,771 | B1 * | 5/2005 | Cantolino | ..... | 62/285 |
| 6,931,882 | B1 * | 8/2005 | Yang | ..... | 62/285 |
| 7,578,932 | B2 * | 8/2009 | Cantolino | ..... | 62/285 |

* cited by examiner

*Primary Examiner*—John Rivell
(74) *Attorney, Agent, or Firm*—The Law Office of Jane K. Babin, Professional Corporation; Jane K. Babin

(57) ABSTRACT

The present invention provides a conduit trap, which can also operate as condensation recovery device when installed in a refrigeration system drainage line. The conduit trap is generally a hollow body defining a fluid path that includes an upper conduit 20, having a waste outlet 30 and optionally a condensation collection outlet 32. A lower conduit 22 extends downwardly from the upper conduit and has a narrowing that creates an inner sealing region for receiving a sealing means, such as float 50. Condensation can be directed from the refrigeration system through the conduit trap for recovery or for disposal without exposing the refrigeration drainage line and occupied space in which the refrigeration unit is located to sewer gasses even in dry weather when a gravity based, fluid-filled trap would fail.

12 Claims, 8 Drawing Sheets

CONDUIT TRAP AND CONDENSATION RECOVERY DEVICE

FIELD OF THE INVENTION

The present invention relates generally to the field of refrigeration drainage. More particularly, it relates to a conduit trap that can be used to prevent sewer gas back up in a drainage line from a refrigeration system. The present invention is useful under dry conditions, when the refrigeration system is turned off and when used intermittently. The conduit trap of the invention can also be adapted for recovering water from refrigeration condensation. The invention also relates methods for recovering water from refrigeration condensation using a conduit trap of the invention.

BACKGROUND

Refrigeration systems are used in air conditioners, dehumidifiers, refrigerators, freezers and the like, including commercial coolers, meat lockers, cold rooms, walk-in freezers and walk-in refrigerators. Typical refrigeration systems pass air over fluid- or gas-filled coils, typically with the aid of a fan. A desired refrigeration temperature is achieved through the use of a fluid or gas refrigerant that can be delivered through the coils at a desired temperature. A simple cooling system can use water as a refrigerant if it can be delivered at a desired temperature. More sophisticated refrigeration systems use chlorofluorocarbons (e.g., Freon), environmentally friendly hydrofluorocarbons (e.g., R406a and R 134a), or other refrigerants, which are recirculated through a closed circuit. The refrigerant is typically cooled to a desired temperature by a compression/expansion process that uses a mechanical compressor. Heat transfer systems based on similar principles are found in other applications that are well known in the art, such as heat pumps.

When the temperature of a refrigerant passing through a chilled refrigeration system coil (e.g., an evaporator coil) is lower than the dew point of the surrounding air, condensation tends to form on the evaporator coils and must be removed. In small scale refrigeration systems, such as household refrigerators, this can be accomplished through a drip pan that collects the condensate (i.e., water) and is either manually emptied or evaporated. However, in larger applications, such as commercial refrigerators, freezers and air conditioning systems, the condensation must be drained away from the coils and is usually emptied into a municipal waste or sewer line.

Drain lines that empty into a sewer system typically employ traps to maintain a barrier between occupied spaces and the sewer, so that sewer gases containing sulfuric acid, methane, and other noxious vapors having unpleasant odors, do not back up into the occupied space. Various styles of traps that prevent the escape of sewer gas through a drain have been available since the beginnings of indoor plumbing. P and S style traps have most commonly been used during the last century. These traps rely on fluid (e.g. waste water) flowing through a generally U-shaped length of drain pipe. Due to the force of gravity, a column of fluid is retained in the U of the trap when fluid flow is stopped, thereby creating a barrier to back up of sewer gas. However, in periods of infrequent use, the fluid may evaporate from such traps, allowing gas to enter an occupied space. In a household environment, a homeowner may need to run the faucet in an infrequently used sink or bathtub occasionally, in order to maintain a fluid barrier in the trap and prevent foul-smelling gas from entering the home.

Gas traps can also be used in connection with refrigeration systems, particularly when the system is large and/or enclosed in an occupied or interior utility space. During periods of dry weather or when the system is not in seasonal use (i.e., air conditioning units that are not used in cooler weather), the fluid in such traps can dry out, thereby permitting back-up of sewer gas. Unlike residential plumbing drains, however, refrigeration drains may not be easily accessible for manual refilling. Indeed, such drains may be enclosed in walls or in hard-to-reach areas. Furthermore, a water source, such as a water supply line, is not usually installed in connection with a refrigeration drain trap, making refilling of the trap inconvenient if not impossible.

Moreover, the condensation produced by a refrigeration system is a relatively pure source of fresh water, much like rain water. The availability of sources of pure, fresh water are dwindling in many areas of the world as populations expand in areas where fresh water supplies are limited. In some areas, efforts to conserve water are necessary. For example, many housing developments and municipalities in Southern California have installed systems to recover rain and irrigation run-off, which can be recycled or partially purified for use e.g., in landscape irrigation. Such recaptured and recycled water utilization is estimated to save millions of gallons of water a year that would otherwise need to be imported from other regions of the country.

Refrigeration condensation could provide an additional source of fresh water in water-restricted areas of the world if there were an efficient way to capture it. Even in areas where the availability of fresh water is not a problem, collection and recapture of refrigeration condensation could lessen the burden on sewage treatment systems and municipal water purification systems, while increasing the efficiency of refrigeration systems generating condensation.

SUMMARY OF THE INVENTION

The present invention provides a conduit gas trap for use in refrigeration system drain lines to prevent sewer gas back-up during periods of dry weather or under-use where a standard P or S trap would fail due to evaporation.

The conduit trap is generally a hollow body defining a fluid path that includes a hollow body which has a substantially vertical upper conduit having at least one fluid outlet, and a lower conduit extending downwardly from the lower end of the upper conduit that is adapted at its lower end to be fluidly connected to a refrigeration drainage line and having an inner sealing region. The conduit trap also includes a sealing means disposed in the interior of the hollow body that rests in a sealably seated position in the sealing region of the lower conduit when condensation fluid is not flowing through the conduit trap along the fluid path and the seating of the sealing means forms a gas barrier. In use, the sealing means is displaced upwardly in the interior of the hollow body by fluid flowing therethrough along the fluid path. The conduit trap also includes at least one fluid outlet in the upper conduit, which is disposed above the sealing means in its seated position.

The fluid outlet can be a waste outlet adapted for connection to a sewer line, a condensation collection outlet, or both. When both outlets are present the condensation collection outlet is disposed below the waste outlet. The condensation collection outlet may be may be fluidly connected to a condensation collection tube and may include a cap or valve adapted for stopping the flow of fluid therethrough.

The sealing means can be a float having a spherical, conical or cylindrical shape and may be made from plastic, rubber, expanded polystyrene and silicone and/or other materials The inner sealing region of the lower conduit may be a narrowing of the lower conduit and as such, the lower conduit may have an upper circumference larger than its lower circumference.

In addition, the conduit trap can include a clean-out port, such as one disposed in the top of the upper conduit and covered with a removable cap.

The present invention also relates to conduit traps that are condensation recovery devices for plumbing refrigeration drainage systems. Such condensation recovery devices are similarly hollow bodies defining a fluid path. These devices include a substantially vertical upper conduit having a waste outlet fluidly connected to a sewer line, a condensation collection outlet for recovering refrigeration condensation, and a lower conduit extending downwardly from the lower end of the upper conduit that is adapted at its lower end to be fluidly connected to a refrigeration drainage line and having an inner sealing region.

The condensation recovery device conduit traps have a sealing means which is typically a float that is slidably disposed in the interior of the hollow body of the conduit trap. The float will typically have a maximum outer circumference that is approximately equal to the minimum inner circumference of the upper conduit, and will rest in a sealably seated position in the sealing region of the lower conduit (which can be a narrowing of the lower conduit) when there is no condensation flowing along the fluid path in the conduit trap. The seating of the float thereby forms a gas barrier. The conduit trap and condensation recovery device set forth in claim 11, wherein the inner sealing region of the lower conduit comprises.

When condensation is produced by the refrigeration system, the float is displaced upwardly in the interior of the hollow body by fluid flowing therethrough and as such must have sufficient buoyancy in water to float. The float may be generally spherical, conical or cylindrical in shape and can be made of plastic, rubber, expanded polystyrene and silicone and the like.

To selectively recover condensation, the condensation collection outlet of the conduit trap and recovery device is disposed below the waste outlet and can be either above the float in its seated position as or below the float. To selectively control flow through the conduit trap and recovery device, a condensation collection tube may be attached to the condensation collection outlet and can be stopped by a cap or stopper, or can be controlled with a valve.

To facilitate cleaning of the conduit trap and condensation recovery a clean-out port can be included in, for example at the top of the upper conduit, and can be fitted with a removable cap can to prevent dirt and foreign objects from becoming lodged in the conduit trap. Either the cap of the clean out port can be threaded, with the other part adapted to receive such threads. Alternatively, the removable can cover the clean-out port by means of a compression fitting or a hinged fitting.

In one embodiment of the invention, the conduit trap and condensation recovery device also includes a substantially P shaped trap fluidly connected to the lower end of the lower conduit for receiving condensation from a refrigeration system.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 5 shows the trap in operation with condensation fluid flowing outwardly through a waste outlet and waste outflow tube.

FIG. 6A shows the baffle without the float sealing means and FIG. 6B shows the float sealably seated on the baffle of the inner sealing region.

DETAILED DESCRIPTION OF THE INVENTION

Figure 1:
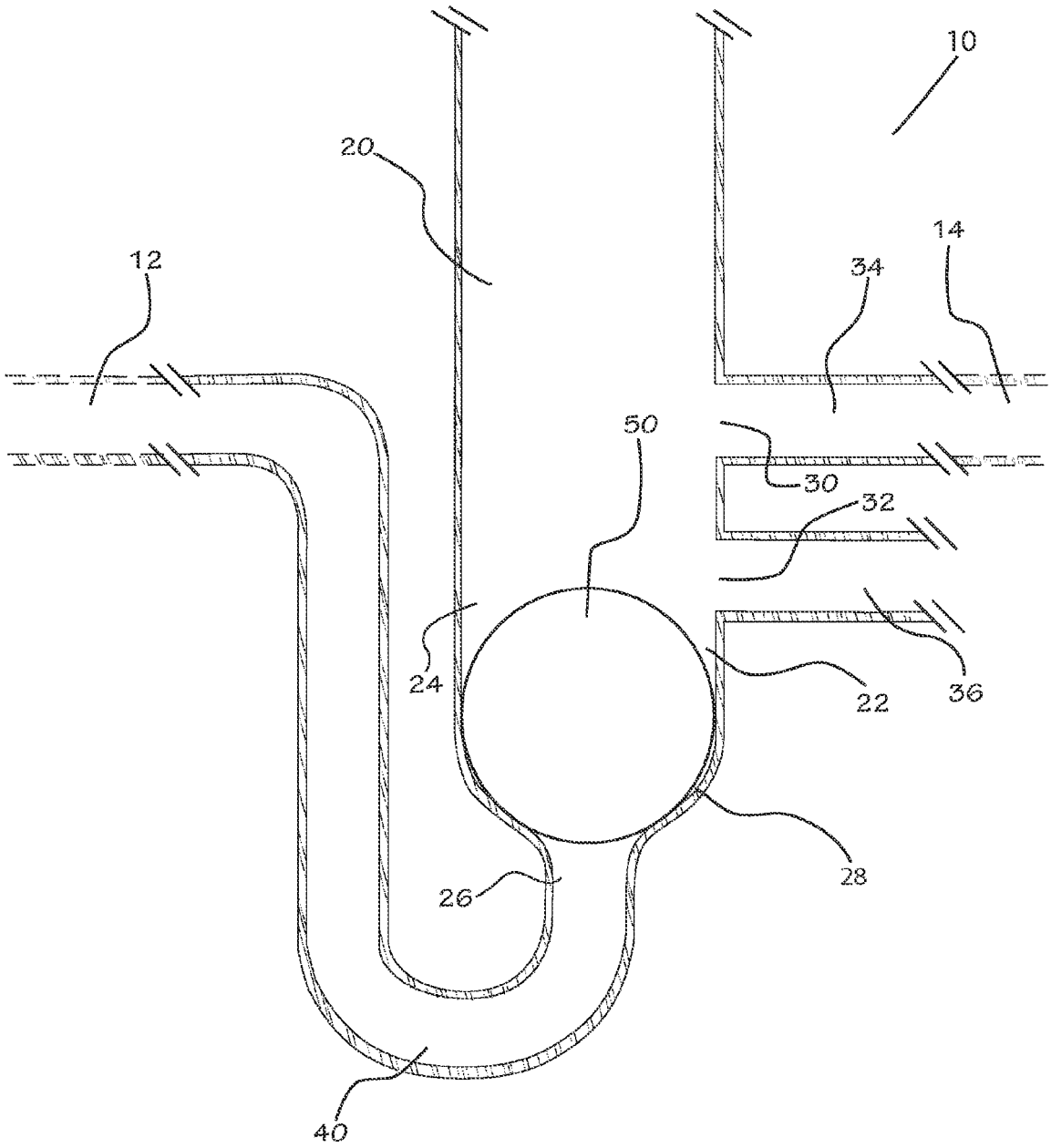
FIG. 1 is a sectional view of the conduit trap in accordance with an embodiment of the present invention installed in a refrigeration drainage line and connected to a sewer line.

Referring to the drawings and in particular to FIG. 1, the conduit trap of the present invention is shown generally at 10 as installed in a refrigeration system drainage line 12, and connected to a sewer line 14. As used herein, "conduit" refers to a channel, such as a pipe or tube through which fluid is conveyed. The conduit trap 10 can be generally understood as a hollow body defining a directional fluid path from refrigeration system drainage line 12 to sewer line 14. The hollow body includes an upper conduit 20, which is installed in a substantially vertical position. Disposed on upper conduit is at least one fluid outlet, such as waste outlet 30, condensation collection outlet 32, or both a waste outlet 30 and a condensation collection outlet 32 as illustrated in FIG. 1. As described below in greater detail, when both waste outlet 30 and condensation collection outlet 32 are present, waste outlet 30 is preferably disposed above condensation collection outlet 32. In order to accommodate the configuration of adjacent equipment or structures, the waste outlet 30 can, but need not be, disposed directly above condensation collection outlet 32, as is illustrated in FIG. 1. Alternatively, the outlets can be positioned on opposite sides of the upper conduit 20 (180° apart), or at any convenient position relative to each other.

The conduit trap 10 also includes lower conduit 22 extending downwardly from the lower end of upper conduit 20 as illustrated in FIG. 1. Lower conduit 22 is adapted at its lower end to be fluidly connected to a refrigeration drainage line 12 either directly, or for example, through a trap, such as P trap 40 shown in FIG. 1. As used herein, "P trap" refers to a generally P shaped conduit used, for example as a gravity based, fluid-filled gas trap in plumbing installations. "S traps" are similar conduits with a generally S shape. Both types of traps are well known in the art.

In certain embodiments of the invention, the conduit trap 10 includes P trap conduit 40 as an integral part of the conduit trap 10. Alternatively, the conduit trap of the present invention may be fluidly connected to the P trap 41 of an existing refrigeration system drainage line (as shown by broken lines in FIG. 4). In other embodiments, the conduit trap includes or is fluidly connected to an S trap or other gravity-based fluid-filled trap. The skilled artisan will appreciate that the conduit trap may be fitted into an existing drainage line containing an existing P or S trap. Where the existing drainage system does not contain a P or S trap, the conduit trap 10 of the present invention may optionally include this element as part of the overall structure to provide an additional, fluid-based barrier to sewer gas back up.

Figure 6A:
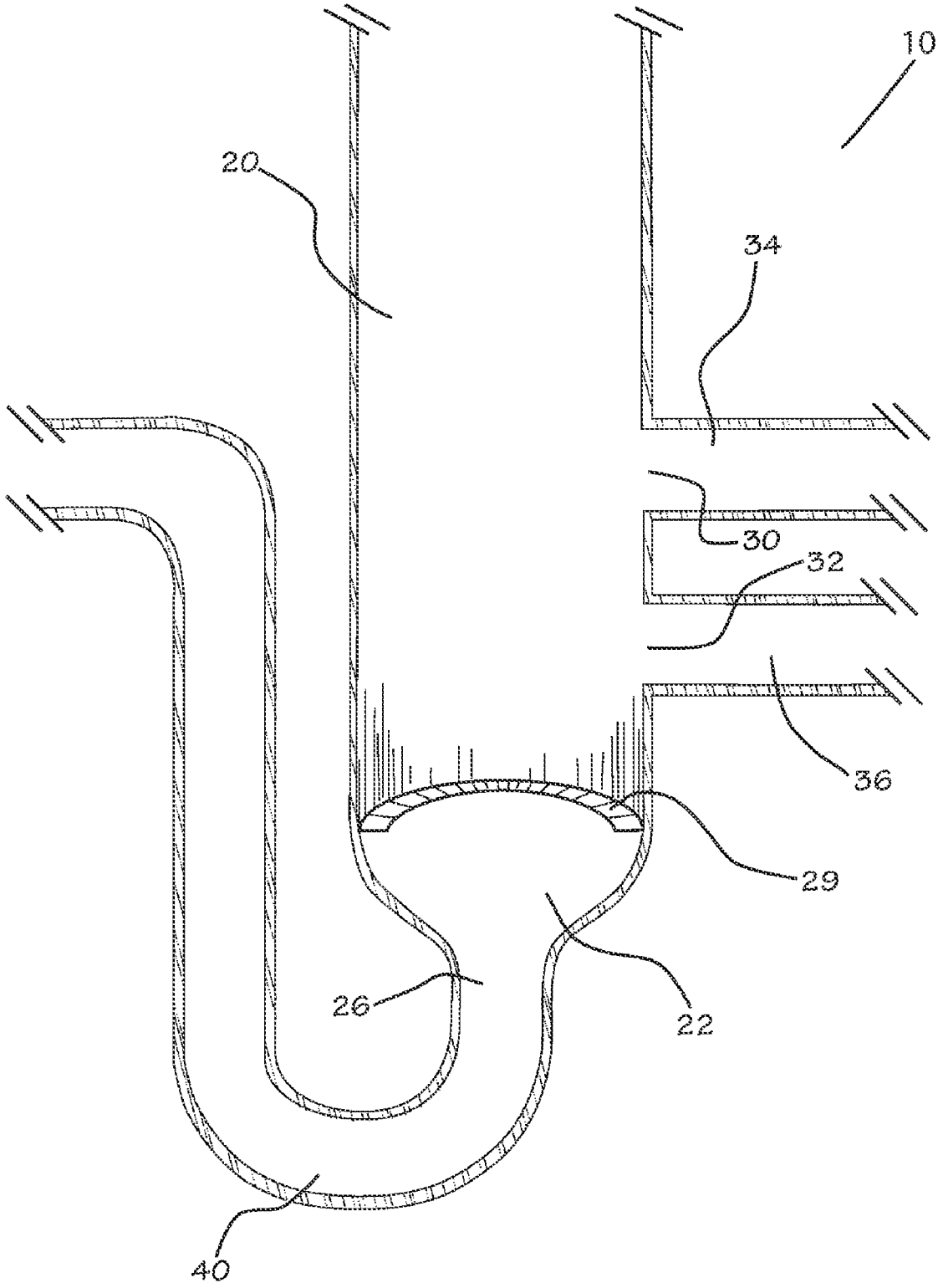
FIGS. 6A and 6B are sectional views of the conduit trap in accordance with an embodiment of the present invention where the inner sealing region includes a baffle.
Figure 6B:
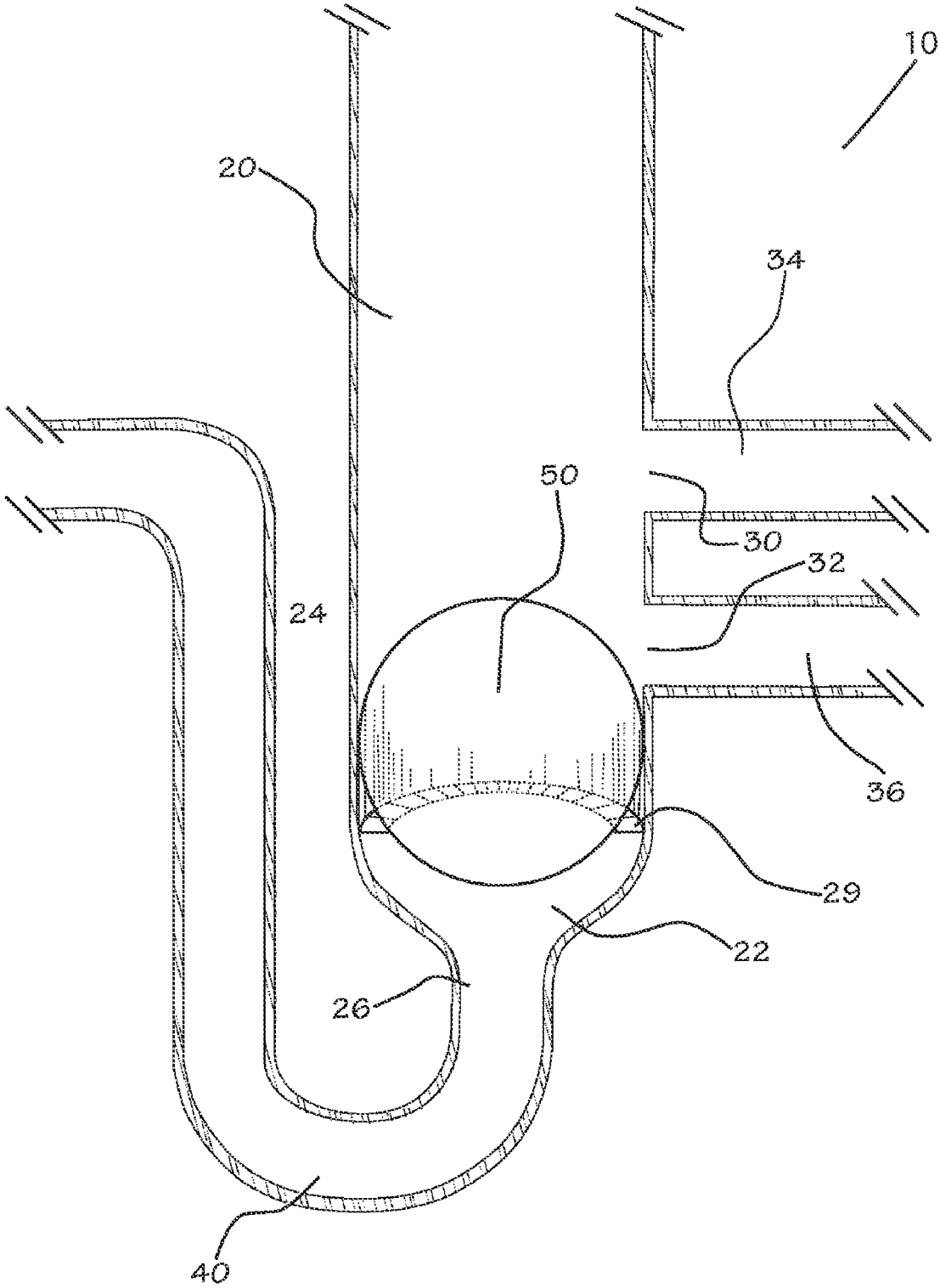

Lower conduit 22 includes an inner sealing region 28 adapted for sealably seating a sealing means, such as float 50 (described below). In one embodiment of the invention, the inner sealing region 28 is formed by a narrowing of lower conduit 22, through which float 50 cannot pass and upon which float 50 can sealably rest. For example, as shown in FIG. 1, the lower conduit may taper toward its lower end, such that the lower end 26 of lower conduit 22 is narrower than the upper end 24 of the lower conduit 22. According to this embodiment, the upper end 24 of lower conduit 22 is mated to the size of upper conduit 20 and has a narrower circumference at its opposite, lower end 26, which may be mated to a P trap or refrigeration drainage line In another embodiment of the invention, inner sealing region 28 may include a ridge, indentation, baffle 29 or the like, disposed, applied or formed on an inner surface of lower conduit 22 (FIG. 6A) and upon which float 50 rests in its seated sealing position, as illustrated in FIG. 6B. Inner sealing region 28 may further comprise a coating or gasket to facilitate sealably seating of float 50.

The circumference of upper conduit 20 and lower conduit 22 can be any size provided they accommodate the maximum flow of condensation fluid produced by the refrigeration system without excessive force on any parts of the refrigeration drainage line 12, conduit trap 10 or other pipes, tubes or lines fluidly connected thereto. In one embodiment of the invention, the upper and lower conduits each independently have a circumference of a standard plumbing pipe. According to this embodiment, the upper conduit 20 may have a circumference of a relatively larger standard plumbing pipe (such as 2" or 3"), and the narrow end of the reducing conduit may have a circumference of a relatively smaller standard plumbing pipe (such as ½", 1" or 1½"). In one aspect of the invention, the narrow, lower end 26 of lower conduit 22 has the same circumference as P trap 40.

Figure 2:
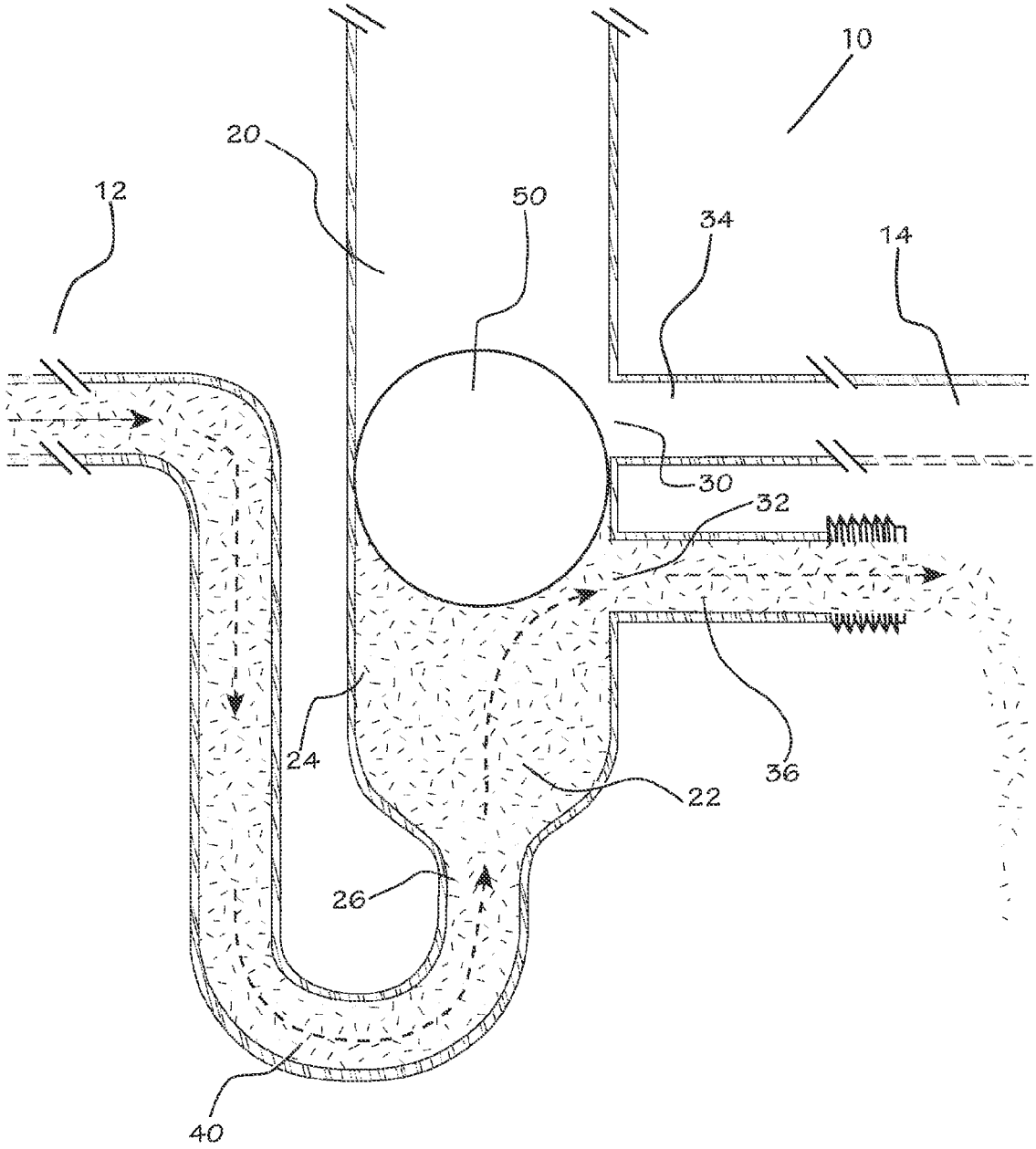
FIG. 2 is a sectional view of the conduit trap in accordance with an embodiment of the present invention in operation with condensation fluid flowing outwardly through a condensation collection outlet and condensation collection tube.
Figure 3:
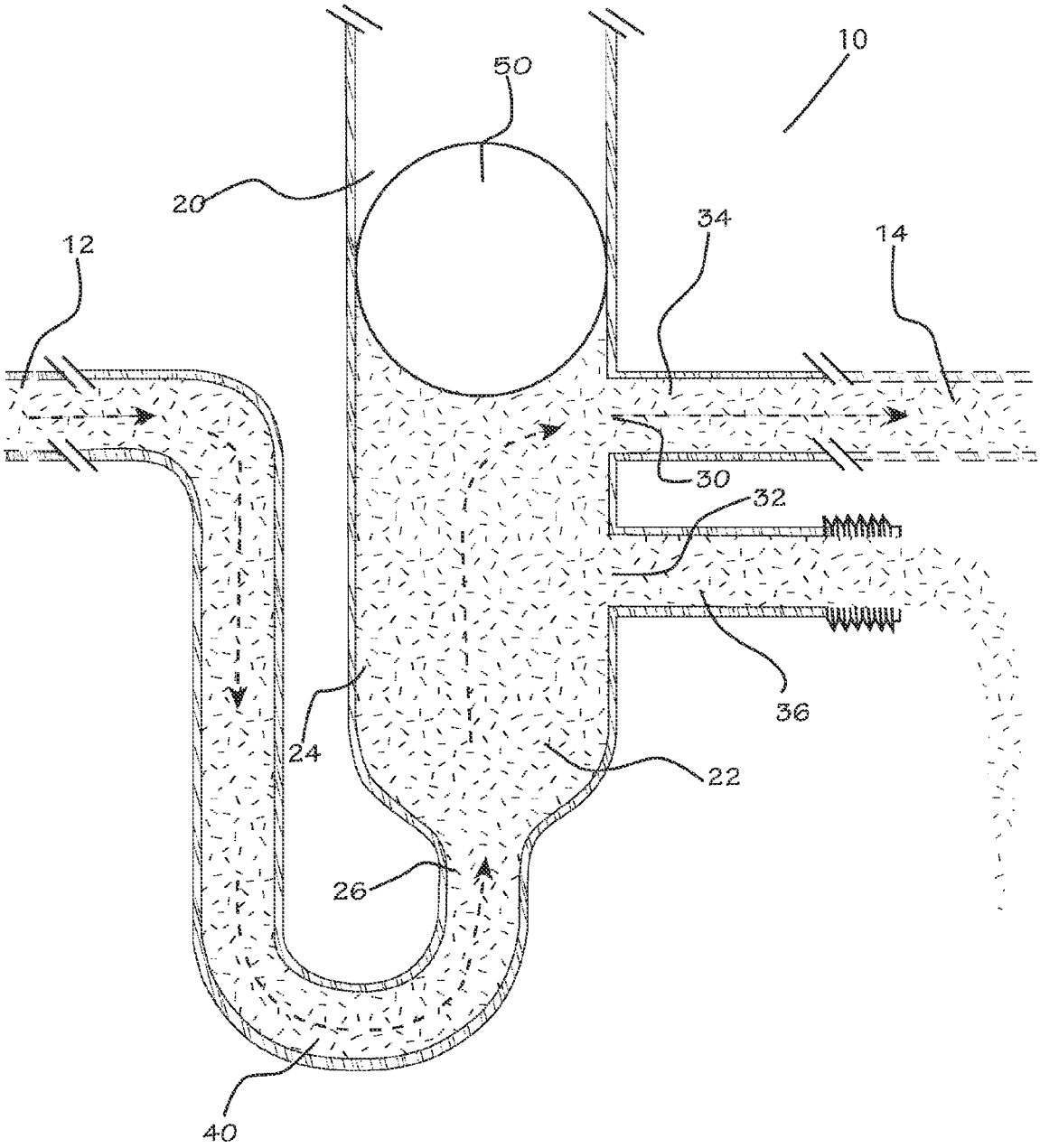
FIG. 3 is a sectional view of the conduit trap in accordance with an embodiment of the present invention in operation with condensation fluid flowing outwardly through a condensation collection outlet and condensation collection tube and with overflow flowing outwardly through a waste outlet and a waste outlet tube.

Disposed within the hollow region of the conduit trap 10, which is formed by the contiguous hollow regions of upper conduit 20 and lower conduit 22, is a sealing means, such as float 50. As used herein, "float" refers to a body that is capable of floating in water, and more specifically, to one that can be contained within the hollow region of conduit trap 10. Float 50 is designed to fit slidably within the hollow interior of upper conduit 20, but snugly and sealably in the inner sealing region 28 of lower conduit 22 as shown, for example, in FIGS. 1-3. In operation, in the absence of condensation flowing through conduit trap 10, float 50 is seated in the inner sealing region 28 of lower conduit 22, forming a seal against the back-flow of sewer gasses into refrigeration drainage line 12 (FIG. 1). When condensation (e.g. water) is produced by the refrigeration system, it flows directionally along the fluid path from drainage line 12 through the conduit trap 10, as indicated by the arrows in FIGS. 2, 3 and 5. Float 50 is displaced upwardly by the flowing fluid, thereby exposing at least one fluid outlet, such as waste outlet 30 or condensation collection outlet 32. In one embodiment, upward displacement of float 50 exposes condensation collection outlet 32, through which condensation fluid can flow outwardly for collection (FIG. 2). In another embodiment of the invention, upward displacement of sealing float 50 exposes waste outlet 30, through which fluid can flow outwardly for disposal (FIG. 3).

In a preferred embodiment of the invention, condensation collection outlet 32 is disposed beneath waste outlet 30 by a sufficient distance that condensate flows out through condensation collection outlet 32 before reaching the waste outlet 30, as illustrated in FIG. 2. According to this embodiment, if the flow of condensation exceeds the capacity of condensation collection outlet 32 or any downstream conduits, tube, pipes or collection containers, the hollow region of upper conduit 20 above condensation collection outlet 32 fills, thereby further displacing float 50 upwardly and exposing waste outlet 30. The overflow of condensation can then flow outwardly through waste outlet 30 for disposal (FIG. 3).

Float 50 can be of any shape and constructed of any material provided that it will form a barrier to sewer gas back-up when seated in the inner sealing region 28 of lower conduit 22, and can be displaced upwardly by the flow of condensation fluid. Specifically, float 50 should be constructed in such a manner that it is buoyant in condensation fluid (i.e. will float in water) and thereby will be easily displaced upwardly by flowing condensation fluid. Furthermore, the float 50 should slide easily by gravity into a seated, sealing position in the inner sealing region 28 of lower conduit 22 when fluid flow stops.

In certain embodiments of the invention, float 50 is a generally hollow sphere, cylinder or cone having a maximal outer circumference approximately equal to or slightly smaller than the inner circumference of upper conduit 20. For purposes of illustration, float 50 is shown in cross-section as a sphere in FIGS. 1-3, 5 and 6B. Suitable materials for constructing float 50 in a hollow, spherical ball, cylinder or cone shape include, but are not limited to, rubber, vinyl, silicone, polyvinyl chloride, polystyrene, polypropylene and other plastics. In other embodiments of the invention, float 50 is a solid sphere, cylinder, or cone constructed from a material having a buoyant density less than water, such as expanded polystyrene (i.e., Styrofoam).

Figure 4:
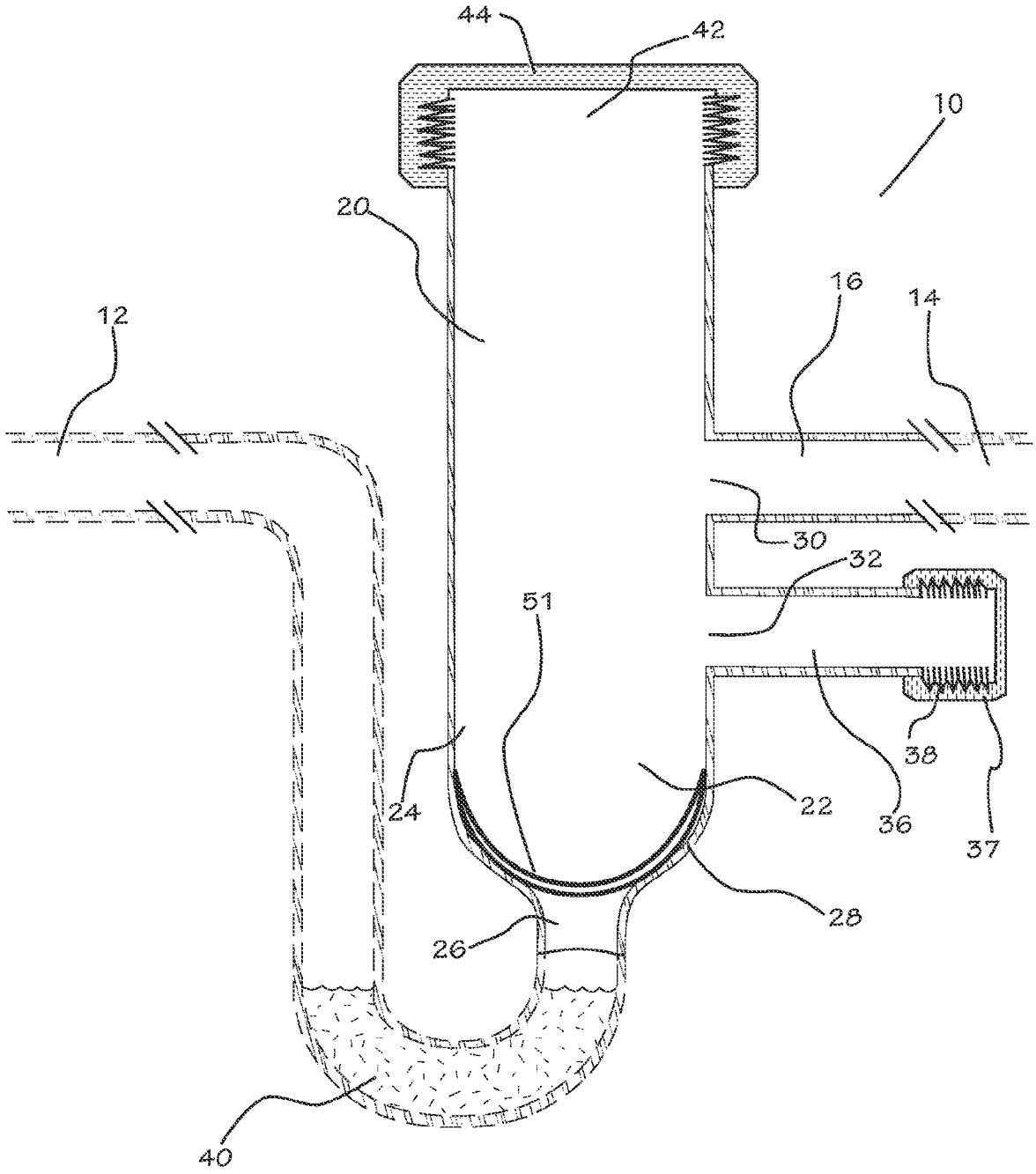
FIG. 4 is a sectional view of the conduit trap in accordance with an embodiment of the present invention having a clean-out port and cap, a capped condensation collection tube and a diaphragm sealing means Also shown in FIG. 4 is a barrier column of fluid in a P trap that is connected the conduit trap.

In yet another embodiment of the invention, the sealing means may include a circular gasket or flexible diaphragm 51 (as illustrated in FIG. 4) having an outer circumference about the same as the inner circumference of upper conduit 20. Such sealing means may be made entirely or partially of a flexible material adapted for sealing, such as rubber or silicone. It will be appreciated that such circular gasket or flexible diaphragm sealing means according to the invention may advantageously have a concave shape to ensure proper seating against the inner sealing region 28 of lower conduit 22, and to facilitate effective sealing thereto, as illustrated by the flexible diaphragm 51 shown in FIG. 4. Furthermore, a circular gasket or diaphragm sealing means according to the invention may include a frame, weight, flotation part or other suitable structure for facilitating floatation and/or maintaining the generally upright orientation of the sealing means within upper conduit 20 and lower conduit 22.

It is also intended by the present invention that the sealing means may be a flap anchored within the conduit trap or a similar functionality to allow for directional flow of condensation, but provide a seal against back up of sewer gas in the absence of fluid. Optionally, a sealing means suitable for use in the present invention may include at least one circular o-ring type gasket to effect a seal within the inner sealing region 28 of lower conduit 22. Preferably, such o-rings are constructed of a flexible material that does not reduce the slidability of float 50 within the upper conduit 20.

The invention also contemplates that in use under some conditions, the sealing means need not make a perfect seal against the inner sealing region 28 of lower conduit 22. For example, where a P or S trap is included in the conduit trap, or is used in connection with the invention, it may be sufficient to substantially reduce evaporation of fluid in the P or S trap for the conduit to function as a trap. For example, under certain conditions, such as when condensate flow is intermittent due to occasional dry weather, the conventional fluid-filled gravity trap (e.g., S or P trap) may retain a sufficient column of fluid to prevent back-up of gasses when condensate evaporation is reduced by the sealing means, as shown in FIG. 4.

In yet another embodiment of the invention, the conduit trap does not include P trap 40 or S trap, but instead terminates at the refrigeration system drainage line. According to one aspect of this embodiment, conduit trap 10 alone is sufficient to prevent sewer gas back up and therefore, the standard fluid-filled trap functionality can be eliminated. Alternatively, a conduit trap 10 of the present invention, can be fitted directly to the outlet of a standard P trap 40 (indicated in FIG. 4 by broken lines), or other type of trap, such as an S trap or the like.

In operation, sealing means such as float 50 provides a barrier between refrigeration system drainage line 12 (and occupied space coextensive therewith), and sewer line 14, thereby preventing sewer gas from entering the occupied space, as shown for example in FIGS. 1 and 4. When condensation is produced by the refrigeration system, it flows directionally through the conduit trap 10 along the fluid path, substantially filling lower conduit 22. The further flow of fluid upwardly displaces float 50 and thereby exposes at least one outlet which allows condensation fluid to flow outwardly therethrough.

In one embodiment of the invention, float 50 is displaced to expose waste outlet 30, thorough which condensation fluid can flow toward a sewer. In certain aspect of this embodiment, waste outlet 30 is adapted to be directly and fluidly connected to sewer line 14. In other aspects, the conduit trap 10 includes waste outflow tube 34, which can be fluidly connected to sewer line 14.

A gas trap function is provided by the conduit trap of the present invention even when waste outlet 30 is exposed to the fluid path because a column of condensation fluid is both necessary for exposing waste outlet 30 and sufficient to provide a barrier to sewer gas back up. In operation, the flow of condensation substantially fills upper conduit 20 from the bottom up before reaching waste outlet 30. Thus, as float 50 or other sealing means is displaced upwardly, and waste outlet 30 is exposed, the column of fluid in the upper and lower conduits (20 and 22) provides a barrier between the sewer and occupied space, as shown in FIGS. 2 and 3. When condensation flow is interrupted or stopped, float 50 (or other sealing means) slides back into a seated position in the inner sealing region 28 of lower conduit 22, thereby effecting a seal.

Furthermore, in certain aspects of the invention where the conduit trap contains or is fluidly connected to a P- or S-type trap, a column of fluid is retained in the U of the trap beneath lower conduit 22, providing an additional barrier between the sewer and occupied space, as illustrated in FIG. 4.

In certain embodiments of the invention, condensation collection outlet 32 is present, allowing the trap to act as a condensation recovery device. In such embodiments, condensation can be allowed to flow outwardly through condensation collection outlet 32 for recovery, rather than through waste outlet 30 for disposal, as shown in FIG. 2. As noted above, the collection of condensation can be controlled in part by positioning the condensation collection outlet 32 below waste outlet 30. Condensation fluid can thereby be allowed to flow outwardly from condensation collection outlet 32 for collection. Only when the capacity of condensation collection outlet 32 or the downstream tubes, conduits or the like are exceeded will the condensation flow reach waste outlet 30, as illustrated in FIG. 3.

Collection of condensation from outlet 32 can be by any means, such as a bucket, carboy or other vessel. In certain aspects of the invention, condensation flowing outwardly through condensation collection outlet 32 can be directed through tubes, pipes or hoses for recovery, to a point of use or for further purification or processing. In one aspect of this embodiment, condensation collection outlet 32 is fluidly connected to a garden hose or irrigation system, thereby supplying irrigation water for landscaping or agricultural use.

Figure 5:
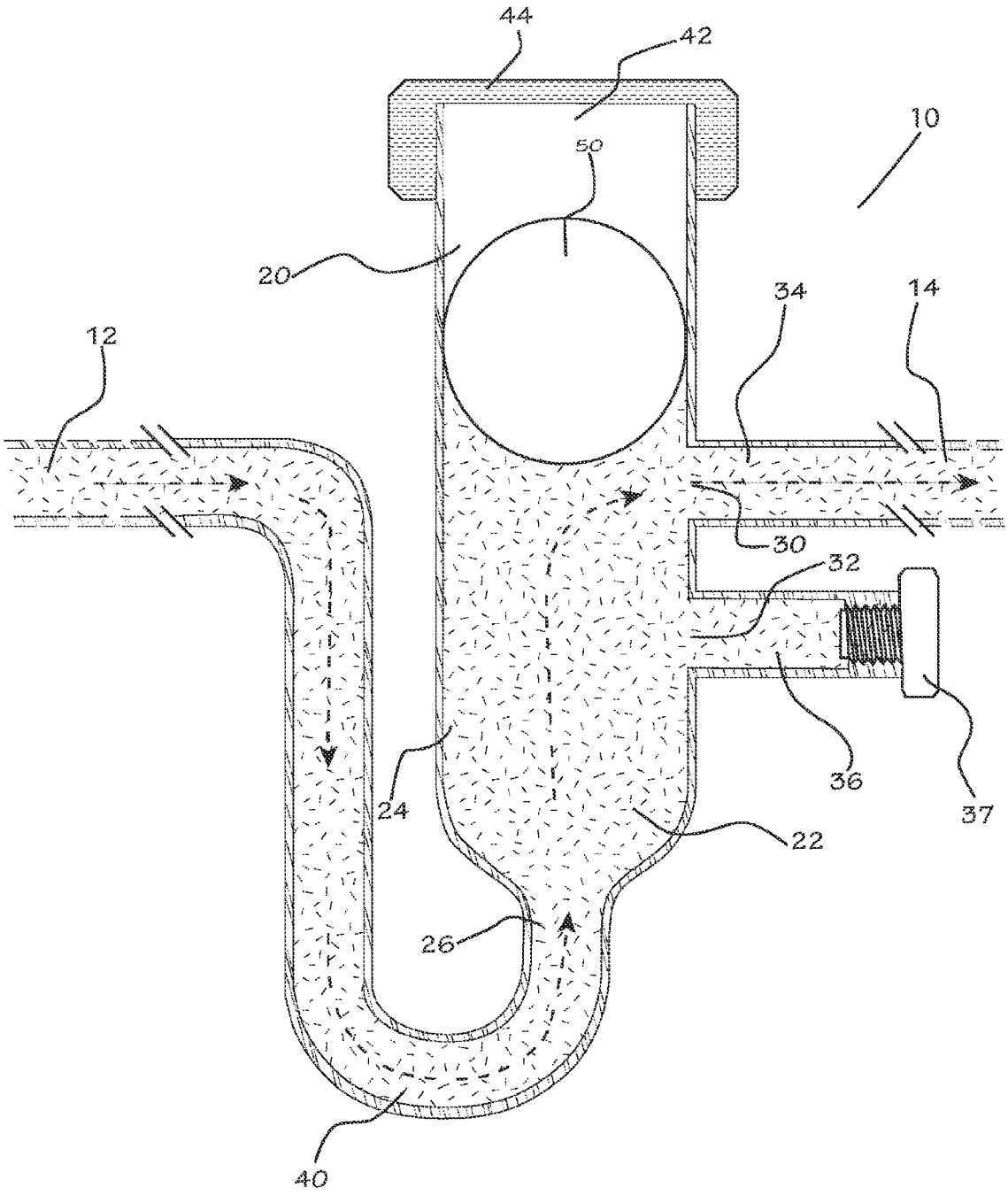
FIG. 5 is a sectional view of the conduit trap in accordance with an embodiment of the present invention having a clean-out port and compression-fitted cap, a condensation collection tube with threaded cap, and spherical float.

Conveniently, the conduit trap 10 can include a condensation collection tube 36 fluidly connected to condensation collection outlet 32 and directed to a desired point of use or collection. Furthermore, outward flow through condensation collection outlet 32 and condensation collection tube 36 can be controlled with various optional parts, such as cap 37. As shown in FIG. 4, the distal end of condensation collection tube 36 can be fitted with male-type screw threads 38 for acceptance by cap 37, which may, in turn, be adapted to sealably the receive male-type screw threads. When fitted with cap 37, flow through condensation collection tube 36 is stopped, thereby diverting condensation to flow upwardly along the fluid path and outwardly through waste outlet 30 for disposal, as illustrated in FIG. 5. The skilled artisan will appreciate that cap 37 can be any type of cap or stopper that will sealably prevent flow through condensation collection tube 36, such as a male-type threaded cap where condensation collection tube 36 is suitably adapted to provide female-type acceptor threads FIG. 5.

The skilled artisan will further appreciate that the distal end of condensation collection tube 36 can be adapted with a variety of capping, stopping or connecting fittings that are well known in the art. For example, male-type screw threads 38 on condensation collection tube 36 can be adapted for connection to a garden hose during condensation collection.

In yet another embodiment of the invention, condensation collection tube can be adapted with a in-line valve means to control flow therethough. A valve means can, for example, be a manual mechanical, screw-type valve or spigot. Alternatively, a valve means according to the invention can be electronically controlled to dispense condensation fluid on a programmed schedule or as needed.

The overall size and construction of the conduit trap of the present invention will be determined by such factors as the size of the drain line to which the trap is attached and the amount of condensation produced by the refrigeration system. The distal ends of the conduit trap can be adapted for connection to tubes, pipes or other conduits of various sizes, such as one and one quarter inch (1¼") diameter, one and one half inch (1½") diameter and two inch (2") diameter for compatibility with standard plumbing supplies.

The trap may be constructed of any suitable, leak-proof or leak-resistant material, including but not limited to cast iron, brass, copper, or plastic, which can for example, be fabricated, tooled, molded, extruded and/or welded to form the conduit trap. In one embodiment of the invention, the conduit trap is constructed of polyvinyl chloride (PVC). Where the conduit trap is adapted for condensation recovery, the trap may be constructed of an inert and/or non-toxic material that will not leach unwanted substances into the recovered condensation.

The hollow body of conduit trap 10 can be constructed as a single unit, for example, by injection molding. Moreover, a single unit construction can include additional conduits, pipes, tubes and/or adaptors such as condensation collection tube 36, waste outflow tube 34 and P trap 40.

Figure 7:
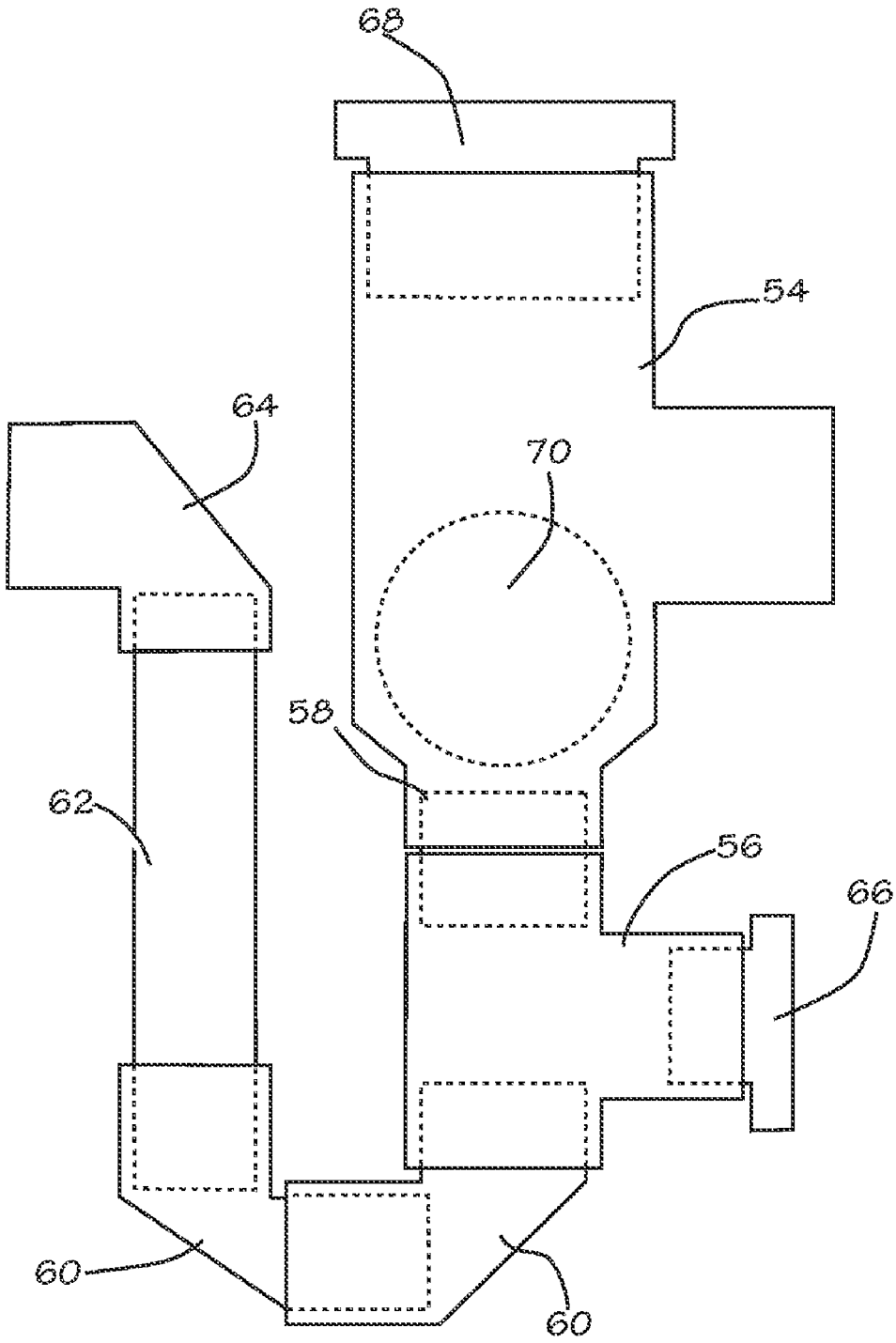
FIG. 7 is a sectional view of a conduit trap in accordance with an embodiment of the present invention where the trap if constructed from schedule 40 PVC plumbing parts including a 1"¾" ¾" SLIP×SLIP×SLIP reducing T, a ¾" ¾" ¾" SLIP×SLIP×FIPT conduit and a ¾" NIP (2" length) (forming the upper and lower conduits, waste outlet, waste outflow tube, condensation outlet, condensation collection tube and clean-out port); two ¾" Street ELLs, a ¾"×4" NIP, and ¾" ¾" SLIP×SLIP 90*ELL (forming a P trap); a 1⅛" rubber sphere (float); a ¾" MIPT plug (to seal the condensation collection tube) and, 1" MT plug to cover the clean-out port

Alternatively, the conduit trap can be constructed from individual conduits and/or other parts, such as stock PVC plumbing parts, that are assembled together. FIG. 7 illustrates one embodiment of the invention constructed from Schedule 40 PVC fitting. As illustrated in this figure, the upper and lower conduits are formed from a 1"¾" ¾" SLIP×SLIP×SLIP reducing T 54, a ¾" ¾" ¾" SLIP×SLIP×FIPT conduit 56 and a ¾" NIP (2" length) 58. The U region of the P trap is formed by connecting two ¾" Street Ells 60, which are connected to a ¾"×4" NIP 62, and terminate with a ¾" ¾" SLIP×SLIP 90*ELL 64. Condensation collection tube (formed by the ¾" ¾" ¾" SLIP×SLIP×FIPT conduit 56) can be plugged with a ¾" MIPT plug 66, while clean-out port 42 (described in greater detail below) can be capped with a 1" MT plug 68. Finally, a 1⅛" rubber sphere 70 is used in this embodiment as a float.

In one aspect of this embodiment, connections between parts can be made using mated male thread and female swedged ends allowing for slip nut connection or solvent weld joints. The conduit trap may utilize threaded connections and or compression fittings, which may include wrapping with Teflon or similar tape to prevent leaks. Similar joinery may be used to install the conduit trap to the drain line, downstream condensation collection lines or vessels, and waste lines. Where the existing drain line is made of copper tubing, conduit trap 10 may be soldered in position. Other suitable means of connecting conduit trap 10 to existing plumbing made of various materials will be well known to those of skill in the art.

To facilitate cleaning the interior of the upper conduit 20, lower conduit 22 and any P or S traps connected thereto, the conduit trap 10 may include a clean-out port 42 and suitably adapted clean-out cap 44. In one embodiment the clean-out port is disposed at the upper terminus of the central conduit as illustrated in FIGS. 4 and 5. In one aspect, clean-out port 42 and clean-out cap 44 include mated male thread and female swedged connectors as shown in FIG. 4. In another embodiment, the cap utilizes a compression fitting to fit snugly over clean-out port 42, as shown in FIG. 5. In yet another embodiment, the cap can be hingeably connected to an exterior surface of the clean-out opening and may be fitted with a closure to prevent unwanted opening. Other means of securing clean-out cap 44 to or otherwise covering clean-out port 42 will be well known to those of skill in the art.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A conduit trap for plumbing a refrigeration drainage system comprising:

a hollow body defining a fluid path, said hollow body comprising a substantially vertical upper conduit having a waste outlet adapted for connection to a sewer line, a condensation collection outlet disposed below the waste outlet and fluidly connected to a condensation collection tube, and a lower conduit extending downwardly from the lower end of the upper conduit, said lower conduit adapted at its lower end to be fluidly connected to a refrigeration drainage line and having an inner sealing region; and a sealing means disposed in the interior of the hollow body, said sealing means resting in a sealable seated position in the sealing region of the lower conduit in the absence of condensation flowing through the trap along the fluid path, thereby forming a gas barrier, said sealing means being displaced upwardly in the interior of the hollow body by fluid flowing therethrough, wherein at least one of the waste outlet and the condensation collection outlet is disposed above the sealing means in its seated position.

2. The conduit trap set forth in claim 1, wherein the condensation collection tube comprises a cap or valve adapted for stopping the flow of fluid therethrough.

3. A conduit trap and condensation recovery device for plumbing a refrigeration drainage system comprising:

a hollow body defining a fluid path, said hollow body comprising a substantially vertical upper conduit having a waste outlet fluidly connected to a sewer line, a condensation collection outlet for recovering refrigeration condensation, and a lower conduit extending downwardly from the lower end of the upper conduit, said lower conduit adapted at its lower end to be fluidly connected to a refrigeration drainage line and having an inner sealing region; and a float slidably disposed in the interior of the hollow body, said float having a maximum outer circumference approximately equal to the minimum inner circumference of the upper conduit, said float resting in a sealably seated position in the sealing region of the lower conduit in the absence of condensation flowing through the trap along the fluid path, thereby forming a gas barrier, said float having sufficient buoyancy to be displaced upwardly in the interior of the hollow body by fluid flowing therethrough, wherein said condensation collection outlet is disposed above the float in its seated position, and wherein said waste outlet is disposed above said condensation collection outlet and below the bottom of the float in its upwardly displaced position.

4. The conduit trap and condensation recovery device set forth in claim 3, wherein the float has a spherical, conical or cylindrical shape and comprises at least one material selected from the group of plastic, rubber, expanded polystyrene and silicone.

5. The conduit trap and condensation recovery device set forth in claim 3, wherein the inner sealing region of the lower conduit comprises a narrowing of the lower conduit.

6. The conduit trap and condensation recovery device set forth in claim 3, further comprising a clean-out port that is disposed in the top of the upper conduit and covered with a removable cap.

7. A conduit trap and condensation recovery device for plumbing a refrigeration drainage system comprising:

a hollow body defining a fluid path, said hollow body comprising a substantially vertical upper conduit having a waste outlet fluidly connected to a sewer line, a condensation collection outlet for recovering refrigeration condensation, and an clean-out port for accessing the interior of the trap; a lower conduit extending downwardly from the lower end of the upper conduit, said lower conduit having an inner sealing region, wherein the lower end of the lower conduit has an inner circumference that is smaller than the inner circumference at its upper end; and a substantially P shaped trap fluidly connected to the lower end of the lower conduit for receiving condensation from a refrigeration system; and a substantially spherical float slidably disposed in the interior of the hollow body, said float having a maximum outer circumference approximately equal to the minimum inner circumference of the upper conduit, said float resting in a sealably seated position in the inner sealing region of the lower conduit in the absence of condensation flowing through the trap along the fluid path, thereby forming a gas barrier, said float having sufficient buoyancy to be displaced upwardly in the interior of the hollow body by fluid flowing therethrough, wherein said condensation collection outlet is disposed below the float in its seated position and wherein said waste outlet is disposed above said condensation collection outlet and below the float in its upwardly displaced position.

8. The conduit trap and condensation recovery device set forth in claim 7, wherein the hollow body is constructed from PVC plumbing parts.

9. The conduit trap and condensation recovery device set forth in claim 7, wherein the condensation collection outlet is fluidly connected to a condensation collection tube comprising a valve or cap for stopping fluid flow therethrough.

10. The conduit trap and condensation recovery device set forth in claim 7, wherein the clean-out port is covered by a removable cap.

11. The conduit trap and condensation recovery device set forth in claim 10, where the removable cap is threaded and the clean-out port is adapted to accept the cap threads, or the removable cap is adapted to cover the clean-out port by means of a compression fitting or a hinged fitting.

12. The conduit trap and condensation recovery device set forth in claim 7, wherein the trap is constructed of PVC and the float comprises at least one material selected from the group of plastic, rubber, expanded polystyrene and silicone.

* * * * *